United States Patent [19]

Landreau

[11] 4,413,590

[45] Nov. 8, 1983

[54] BOILER FOR A HEATING SYSTEM

[75] Inventor: André Landreau, Fontenay-le-Comte, France

[73] Assignee: Jean Mingret, Bressuire, France

[21] Appl. No.: 209,062

[22] Filed: Nov. 21, 1980

[30] Foreign Application Priority Data

Nov. 23, 1980 [FR] France ..... 79 28884

[51] Int. Cl.[3] ..... F22B 5/02

[52] U.S. Cl. ..... 122/18; 122/234; 122/14; 122/15; 122/235 D; 126/392; 126/362; 110/234

[58] Field of Search ..... 237/8 R, 56; 122/18, 122/13 R, 19, 14, 15, 235 D, 234, 332, 333; 126/392, 362, 132; 110/336, 234; 432/238

[56] References Cited

U.S. PATENT DOCUMENTS

| | | | |
|---|---|---|---|
| 2,267,864 | 12/1941 | Hosbein | 432/238 |
| 3,669,041 | 6/1972 | Schworer | 110/234 X |
| 4,194,688 | 3/1980 | Cobos | 126/112 X |

FOREIGN PATENT DOCUMENTS

| | | | |
|---|---|---|---|
| 105597 | 10/1937 | Australia | 122/332 |
| 7507156 | 11/1976 | France | 126/132 |
| 293611 | 7/1928 | United Kingdom | 122/18 |
| 471619 | 9/1937 | United Kingdom | 122/235 D |
| 533858 | 2/1941 | United Kingdom | 122/18 |
| 636769 | 5/1950 | United Kingdom | 122/18 |
| 890896 | 3/1962 | United Kingdom | 122/18 |
| 908806 | 10/1962 | United Kingdom | 122/18 |
| 1048349 | 11/1966 | United Kingdom | 122/18 |
| 1199342 | 7/1970 | United Kingdom | 122/18 |
| 1252347 | 11/1971 | United Kingdom | 122/18 |

*Primary Examiner*—Albert J. Makay
*Assistant Examiner*—Henry Bennett
*Attorney, Agent, or Firm*—Charles E. Brown

[57] ABSTRACT

A liquid or solid fuel-fired boiler for a central heating system is disclosed comprising a combustion chamber and a heat exchanger arranged therearound and connected in a heating fluid circuit comprising an upper header and a lower header interconnected by straight, parallel spaced apart tubular elements for communication therebetween. The tubular elements are disposed along the lateral sides and the back side of the boiler and are embedded in refractory material. Cylindrical interstitial spaces are formed between the tubular elements and the surrounding refractory material to prevent stresses. Flow passages between the tubular elements and the headers are of progressively decreasing cross-sectional area from the back to the front of the boiler thus improving heating fluid flow and temperature uniformity. The lower edge of a cowl defines a throttle passage with the refractory material to control the flow of flue gases to the flue duct.

14 Claims, 7 Drawing Figures

BOILER FOR A HEATING SYSTEM

The present invention relates generally to boilers for central heating systems, and more particularly to such boilers adapted to be liquid or solid fuel-fired.

As is known, such boilers comprise a heat exchanger which is connected in the heating fluid circuit of the heating system, the heat exchanger being in heat transfer relation with the hot flue gases given off in the combustion chamber.

In some boilers such as the one disclosed in German AS No. 1,212,267 published Mar. 10, 1966, the heat exchanger for the heating fluid comprises vertical tubular elements forming threee concentric conduits, the tubular elements opening at their respective ends into upper and lower headers.

In other boilers such as that disclosed and illustrated in German Pat. No. 217,858 of July 23, 1908, the heat exchanger comprises a bundle of vertical tubular elements and a lower bundle of horizontal tubular elements in which the heating fluid circulates. The vertical tubular elements are joined to one another and in communication with the respective upper and lower headers, the heat exchangers thus forming the walls of the combustion chamber.

Finally, in other boilers, such as the case of French printed application for certificate of addition No. 2,348,448 published Nov. 10, 1977, the heat exchanger forms a sort of cage comprising an endless top header, a generally U-shaped bottom header and a series of parallel vertical spaced-apart tubular elements interconnecting said headers for communication therebetween. The series of vertical tubular elements are embedded in their entirety in a refractory material.

The present invention relates to a boiler having a heat exchanger of the foregoing kind including an upper header and a lower header interconnected by a series of vertical tubular elements for communication therebetween.

In the foregoing German AS No. 1,212,267 the heat exchanger comprises a multiplicity of tubular elements making its construction relative complex and expensive. Besides, the tubular elements may be subjected to excessive stresses during operation, provoking nonuniform expansion, bearing in mind that the tubular elements contacting one another form a wall whose inner surface facing the combustion gases is much hotter than the outer surface facing away from the combustion gases, and the tubular elements are also affected by the distance from the source of heat which likewise is variable.

In the aforesaid German Pat. No. 217,858 even though the heat exchanger only comprises a single row of vertical tubular elements establishing communication between the upper and lower headers, these tubular elements are in contact with one another thus giving rise to the very same drawbacks discussed above.

In the French printed application for certificate of addition No. 2,348,448 the heat exchanger is substantially different from the preceding two constructions in the sense that the upper and lower headers are interconnected and brought into communication with each other by vertical, spaced apart tubular elements embedded in a refractory material. In this construction considerable progress is made over earlier arrangements in the field of central heating boilers which may be solid or liquid fuel-fired.

Nevertheless experience has shown, in the course of the service life of the boiler deterioration of the combustion chamber, more particularly the refractory material.

It is known, of course, that the combustion of a solid fuel, in particular, does not produce a temperature in the combustion chamber which is equal throughout so that the refractory material and also the heat exchanger are subjected to undue stresses which in due course produce damage detrimental to the efficiency of the boiler.

It has been observed in particular that the expansion of the heat exchanger, notably the vertical tubular elements may have a damaging effect on the refractory material. It has also been observed that the flow of heating fluid inside the heat exchanger may be irregular since owing to the location of the tubular elements relative to the combustion chamber the temperature is not uniform in all the tubular elements involved.

According to the present invention the heat exchanger of such a boiler is constructed to eliminate or at least very substantially reduce the drawbacks noted above, thereby conferring on the boiler features of excellent sturdiness and thermal efficiency.

According to the invention there is provided a boiler for a central heating system comprising a combustion chamber which, in operation, is hottest adjacent the front of the boiler, a heat exchanger adapted to be connected in a heating fluid circuit including upper and lower headers and a plurality of straight, parallel spaced apart tubular elements interconnecting the headers for the flow of heating fluid therebetween, the tubular elements being disposed along the back and lateral sides of the combustion chamber, characterised in that flow passages between the tubular elements and the upper and lower headers are of progressively decreasing cross-sectional area from the rear to the front of the combustion chamber.

Such an arrangement permits improved circulation of the heating fluid inside the heat exchanger since the large cross-sectional area flow passages are associated with tubular elements subjected to higher temperatures than the tubular elements having small cross-sectional area flow passages. Accordingly, the heating fluid flows faster through the high temperature tubular elements than the lower temperature tubular elements disposed farther from the back, thereby providing more uniform heat exchanger temperature and improving efficiency.

Preferably, a cylindrical interstitial space is provided between the tubular elements and the surrounding refractory material along the entire height of the refractory material, so that the expansion of the tubular elements during operation of the boiler has no damaging effect on the refractory material.

Preferably, the upper and lower headers respectively occupy the entire upper and lower sides of the combustion chamber, the lower header immediately underlying a slab or refractory material, thereby contributing to improve the circulation of the heating fluid inside the heat exchanger.

Such arrangements together confer on the combustion chamber excellent mechanical and thermal characteristics.

Indeed, the refractory material acts an insulating wall and permits the walls of the combustion chamber to be heated to 500° to 800° C. whilst the heating fluid in the heat exchanger itself is substantially at the same temperature as the heating fluid circulating in the heating fluid circuit of the heating system, without the heat exchanger being subjected to excessive stress.

Further, the since the refractory surface is subjected to such advantageously high temperature it defines a self-cleaning surface preventing the sooting of the combustion chamber.

Moreover, the provision of the progressively diminishing cross-sectional areas of the flow passages between the tubular elements and the headers, according to the invention, for the reasons pointed out above, as well as the relatively large size headers provide uniform thermal distribution in the heat exchanger and therefore similarly equal expansion thereof which have no deleterious effect on the refractory material by reason of the cylindrical interstitial spaces. An unquestionable advantage is also obtained in the case of the use of a solid fuel which enables better results even when the center of combustion is displaced in the combustion chamber.

It will be observed that the refractory material covers only the major part of the length of the tubular elements running from the lower ends thereof, the reason being that above this level the flue gases do not soot up the tubular elements. Further, this arrangement enables equal heating capacity to be obtained inside the combustion chamber regardless of the fuel employed.

Such a boiler is of particularly sturdy construction, reliable operation and versatile in that it permits firewood or a liquid fuel, e.g., heating oil, to be utilized.

These and other features and advantageous of the invention will become apparent from the description which follows given by way of example with reference to the accompanying sheets of drawings, in which.

Figure 1:
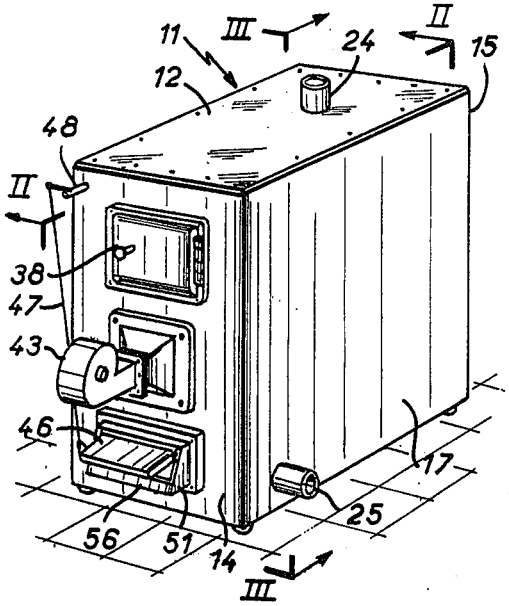
FIG. 1 is an overall perspective schematic view of the boiler embodying the invention for use in a heating system.

In the embodiment illustrated in the embodiment a boiler according to the invention comprises a heat exchanger designed overall by reference numeral 10, the heat exchanger being disposed inside a thermally insulated boiler body 11 of generally known construction, the body 11 being represented for the sake of simplicity as a thick wall in the drawings.

The boiler body 11 which is generally of boxlike configuration comprises, in a known manner, a top wall 12, a bottom wall 13, a front wall 14, a back wall 15 and lateral side walls 16 and 17, all the walls being covered with a suitable thickness of glass wool insulation 18.

Figure 4:
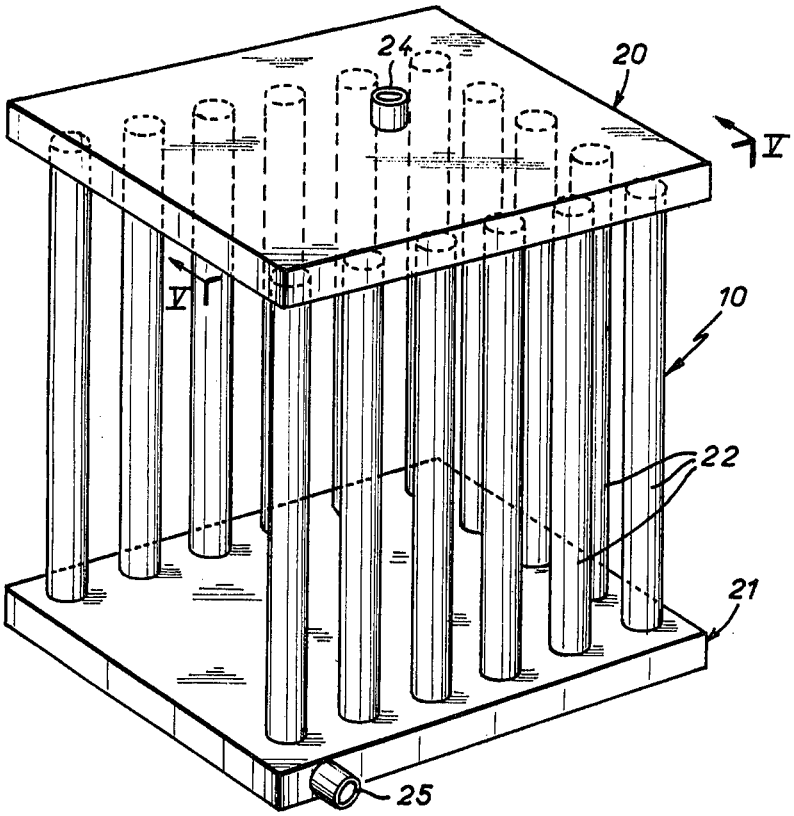
FIG. 4 is a perspective view of the heat exchanger.

The heat exchanger 10 (see FIG. 4 in particular) comprises an upper header 20 and a lower header 21 which are interconnected for the flow of heating fluid, viz. water or water and steam, therebetween via a plurality of tubular elements 22.

The headers 20 and 21 are generally of flattened boxlike configuration and they bear respectively against the top wall 12 and the bottom wall 13 so as they cover the entire cross-section of the combustion chamber. The tubular elements 22 are straight and parallel to one another and perpendicular to the planes parallel to the major faces of the upper and lower headers 20 and 21. The plurality of tubular elements 22 run along side walls 16 and 17 and back wall 15.

The upper header 20 defines the upper surface of the combustion chamber F and comprises in its central area an outlet orifice 24 connected to the heating fluid circuit of the heating system (not shown), and the lower header 21 comprises an inlet orifice 25 arranged, e.g., along a side, receiving water returned from the heating fluid circuit of the heating system.

Figure 5:
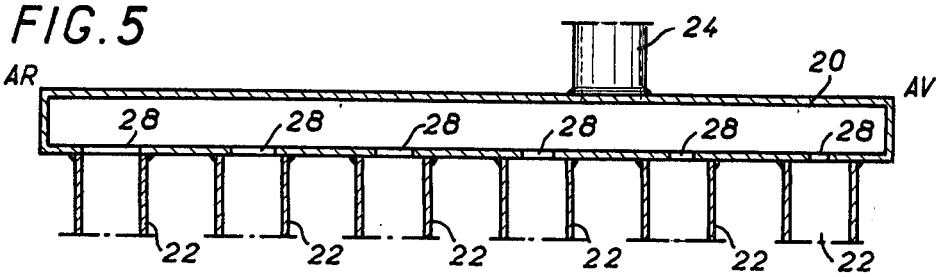
FIG. 5 is a sectional view, on larger scale, taken on line V—V in FIG. 4, this view illustrating in detail the decreasing cross-sectional area of the flow passages between the tubular elements and the upper header.
Figure 6:
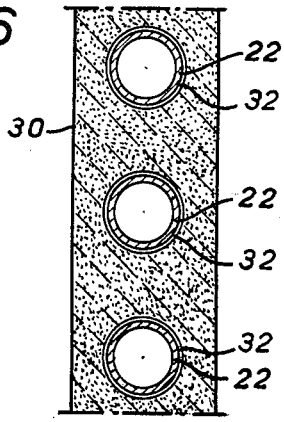
FIG. 6 is a sectional view, on a larger scale, taken on line VI—VI in FIG. 3, this view illustrating the cylindrical interstitial spaces defined between the tubular elements and the surrounding refractory material.

Reference will now be had particularly to FIG. 5 which best shows the tubular elements 22 connected to the upper header 20 by means of welds 27 and a plurality of flow passages 28 bringing the tubular elements 22 into communication with header 20, said flow passages being of progressively decreasing cross-sectional area from the rear AR of the boiler, adjacent the hottest region, and hence from the rear of the combustion chamber, to the front AV thereof.

A similar arrangement is provided for the connection and flow passages arranged between the tubular elements 22 and the lower header 21.

Figure 3:
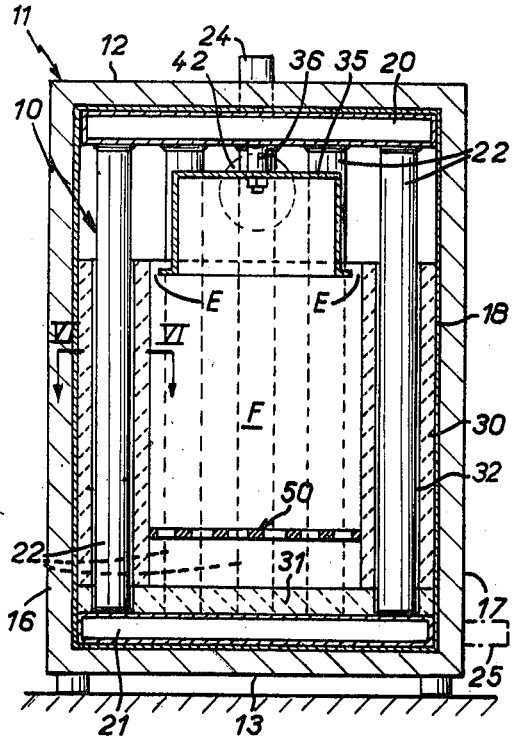
FIG. 3 is a cross-sectional view taken on line III—III in FIG. 1.
Figure 2:
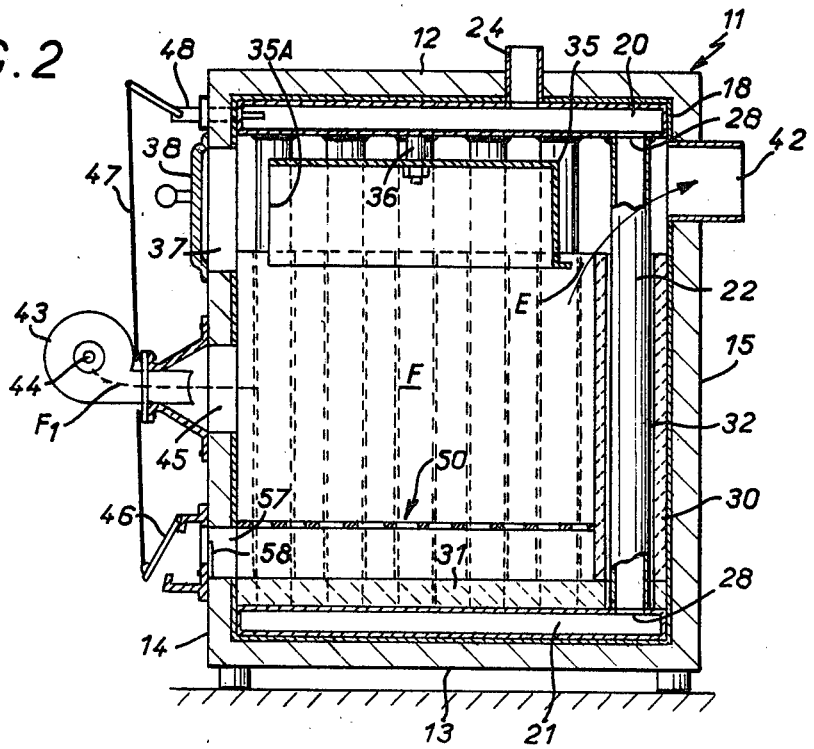
FIG. 2 is a longitudinal sectional view taken on line II—II in FIG. 1.

The tubular elements 22 are uniformly spaced from one another, their inter-axis spacing being preferably equal to twice their diameter. As shown in FIGS. 2 and 3 in particular, the tubular elements 22 are embedded in the refractory material 30, namely, refractory concrete, along the major part of the length of the tubular elements from their lower ends upwards. Preferably, the refractory material extends along three-quarters of the length of the tubular elements 22 reckoned from their lower end.

The bottom surface of the combustion chamber F is defined by a slab 31 of refractory material cast over the lower header 21.

It will be observed that a cylindrical interstitial space 32 is formed between each tubular element 22 and the surrounding refractory material 20 in which they are embedded. To form this interstitial space the tubular elements 22 are coated with a protective coating before the refractory material 30 is cast around them. The protective coating on the tubular elements 22 is adapted to be consumed by the heat produced in the combustion chamber F when the boiler is started up for the first time.

The combination of the flow passages 28 of decreasing cross-sectional area between the tubular elements 22 and the upper and lower headers 20 and 21 and the refractory material 30 extending along the major part of the length of the tubular elements permits uniform expansion of the heat exchanger in such a manner that no part of the heat exchanger or the refractory material is then subjected to any deleterious stresses.

It will be noted that the height of the refractory material embedding the tubular elements is selected so that the heating capacity of the boiler is the same regardless whether the fuel is a liquid, e.g., heating oil or fuel oil, or a solid such as firewood or coal, as a function of the path of flow of the flue gases.

The combustion chamber thus formed is equipped with a cowl 35 fixed to and depending from the upper header 20 by means of a single fastening element 36 thereby permitting unhindered expansion of the cowl in virtually all directions. The cowl 35 is of generally inverted cup shape including an open side wall 35A facing charging opening 37 normally closed by a door 38 provided in the front wall 14 of the boiler body 11.

The cowl 35 is arranged so that the lower edge or lip 40 is disposed slightly below the top edge of the refractory material 30 embedding the tubular elements 22 thus defining a throttle passage E to control the flow of flue gases toward a flue duct 42 extending through the back wall 15 of the boiler body 11.

The front wall 14 of the boiler body 11 in the illustrated embodiment is adapted to support a burner 43 with a secondary air inlet 44 opening into a recess 45. A primary air inlet register 46 also arranged in the front wall 14 is connected by a cable or the like 47 to a thermal sensor 48 protruding into the upper header 20.

Figure 7:
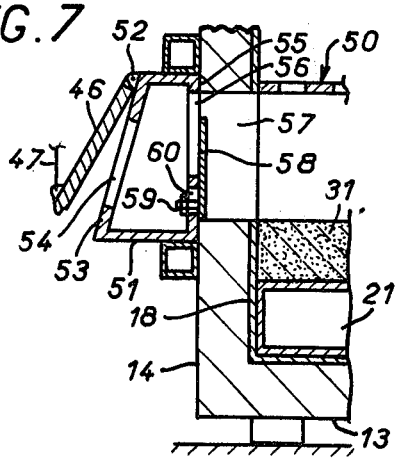
FIG. 7 is a cross-sectional view, on an enlarged scale, taken on line VII—VII in FIG. 1, showing the supply of primary air into the combustion chamber.

The primary air inlet unit, best seen in FIG. 7, comprises a box member 51 fixed to the front wall 14 and the register 46 mounted on a hinge 52. The forward face 53 of the box member 51 has an opening 56 which is disposed opposite a passageway 57 through the front wall 14.

A slide register 58 is vertically slidably mounted on the back side 55 of the box member 51 by means of screw assemblies 59 displaceable in slots 60 provided in this back side 55.

By this arrangement the admission of primary air into the combustion chamber F may be adjusted by positioning the slide register 58 which thus closes off the opening 56 to the desired extent, notably as a function of the draught in the flue duct through which the flue gases are evacuated.

With this arrangement, the admission of primary air into the combustion chamber is constant regardless of the position of the register 46, owing to the thermal sensor 48, right up to the total closure of the register 46 in which position the heating system is at the set temperature of the thermal sensor 48.

A grating 50 is preferably provided parallel to and spaced above the bottom slab 31 of refractory material thereby adapting the boiler for use of a solid fuel in the combustion chamber.

A boiler of the described construction offers, among other advantages, the fact that it does not impart undue stresses on the heat exchanger due to the refractory material modulating the temperature of the heating fluid travelling through the heat exchanger, the temperature of the heating fluid being about 90° C. for a normal central heating system and 105° C. for a superheated heating system.

The straight tubular elements in combination with the surrounding cylindrical interstitial spaces produce no detrimental action on the refractory material which thus keeps its initial mechanical characteristics over an extended period of service.

Further, the throttle passage E between the free edge of the cowl and the adjacent refractory material throttles the flow of flue gases upwards before they reach the flue duct.

Also, when the boiler operates with a solid fuel such as fire wood, the lower slab, given its elevated temperature, acts as an incinerator whereby the small incandescent particles falling to the slab are incinerated and produce practically no ash.

The secondary air flowing through the burner (arrow F1) is admitted at all times inside the combustion chamber F and it is intended to support the combustion of the gases given off during the combustion of the particular solid fuel (e.g. wood, coal or the like).

The configuration of the combustion chamber in combination with the primary and second air intakes helps ensure perfect combustion of the fuel resulting in exceptional boiler efficiency, excellent boiler reliability while avoiding sooting the combustion chamber.

It should be made clear that such a boiler may be equipped, as illustrated in the drawings, with a burner adapted to provide a secondary air inlet or may not be provided with such a burner in case the boiler is intended to solid fuel-fired only. In the latter case the supply of secondary air to the combustion chamber will be effected through an air diffuser with a throttle orifice disposed on the front wall of the boiler body at the location of the burner.

Obviously the present invention is not intended to be limited to the illustrated embodiment but on the contrary is intended to cover embodiments incorporating all variations, modifications and alternatives without departing from the scope of the appended claims.

What I claim is:

1. A selectively solid or liquid fuel boiler for a central heating system, said boiler comprising a combustion chamber, means for selectively supplying liquid or solid fuel and combustion supporting gas to said combustion chamber, a heat exchanger for connection to a heating fluid circuit, said heat exchanger including upper and lower headers and a plurality of straight, parallel spaced-apart tubular elements interconnecting said headers for the flow of heating fluid therebetween, said tubular elements being disposed along the back and lateral sides of said combustion chamber, said tubular elements being embedded in refractory material along the major part of their length from their lower ends upward, said refractory material being positioned for direct contact with a burning solid fuel for maximum solid fuel efficiency, interstitial spaces being formed between said tubular elements and the surrounding refractory material to permit uninhibited expansion of said tubular elements with exposed upper parts of said tubular elements being positioned for direct contact with flue gases produced in said combustion chamber for maximum heat transfer efficiency with a liquid fuel.

2. The boiler according to claim 1, wherein upper and lower headers are of generally boxlike configuration, said upper header forming the upper wall of said combustion chamber and said lower header underlying the bottom wall of refractory material.

3. The boiler according to claim 1, wherein said interstitial spaces between said tubular elements and the surrounding refractory material initially contain a protective coating adapted to be eliminated by heat produced when said boiler is started up.

4. The boiler according to claim 1, wherein a cowl in communication with said combustion chamber is supported by said upper header.

5. The boiler according to claim 4, wherein said cowl has an open side wall facing a charging opening in the front of said boiler.

6. The boiler according to claim 4 or claim 5, wherein said cowl has a lower edge defining a throttle passage with the refractory sidewalls to control the flow of flue gases to a flue duct.

7. The boiler according to claim 5, wherein the interaxis spacing of said tubular elements is approximately twice their diameter.

8. The boiler according to claim 1, wherein the front wall of said boiler comprises a lower, primary air inlet register connected to a thermal sensor for controlling its opening.

9. The boiler according to claim 1, wherein said boiler is liquid fuel-fired, said boiler has a front wall, and a burner is mounted on the front wall of said boiler.

10. The boiler according to claim 1 wherein said refractory material forms side walls and a bottom wall defining said combustion chamber.

11. The boiler according to claim 9, wherein a secondary air inlet is provided in the front wall of the boiler in continuous communication with the burner, at a constant flow rate controller by a secondary air inlet orifice control member.

12. The boiler according to claim 1, wherein passages between said tubular elements and said upper and lower headers are of progressively decreasing cross-sectional area from the back to the front of the combustion chamber.

13. The boiler according to claim 10, wherein the boiler is solid fuel-fired, and a grating is provided parallel to and spaced above the bottom refractory wall of the combustion chamber.

14. The boiler according to claim 1 or 10, wherein the lower three-quarters of the length of the tubular elements are embedded in said refractory material, and the top quarter thereof is exposed to the flue gases.

* * * * *